US007637452B2

(12) United States Patent
Kanbar et al.

(10) Patent No.: US 7,637,452 B2
(45) Date of Patent: Dec. 29, 2009

(54) MOTORIZED ADHESIVE PAPER DISPENSER

(75) Inventors: Maurice Kanbar, San Francisco, CA (US); Albert Kolvites, San Mateo, CA (US)

(73) Assignee: Rex Products, Inc., South San Francisco, CA (US)

( * ) Notice: Subject to any disclaimer, the term of this patent is extended or adjusted under 35 U.S.C. 154(b) by 483 days.

(21) Appl. No.: 11/416,114

(22) Filed: May 2, 2006

(65) Prior Publication Data

US 2007/0257147 A1 Nov. 8, 2007

(51) Int. Cl.
*B65H 20/02* (2006.01)

(52) U.S. Cl. ..... 242/564.4; 225/10; 225/77

(58) Field of Classification Search ..... 242/564, 242/564.1, 564.4, 565, 566; 225/10–16, 225/77; 83/649, 650, 949, 435.2
See application file for complete search history.

(56) References Cited

U.S. PATENT DOCUMENTS

| | | | | |
|---|---|---|---|---|
| 813,128 | A | 2/1906 | Williams | |
| 1,240,279 | A | 9/1917 | Wilson | |
| 1,572,063 | A | 2/1926 | Black | |
| D84,067 | S | 5/1931 | Albritton | |
| 2,331,019 | A | 10/1943 | Flood | |
| D151,072 | S | 9/1948 | Saffert | |
| 2,495,389 | A | 1/1950 | Sammann | |
| D162,059 | S | 2/1951 | Morris | |
| 2,566,733 | A | 9/1951 | Krueger | |
| 2,617,198 | A | 11/1952 | Sharpe | |
| D181,269 | S | 10/1957 | Axcell | |
| 3,065,889 | A | 11/1962 | Grosser | |
| 3,204,949 | A * | 9/1965 | Kieslich | 225/16 |
| 3,507,428 | A | 4/1970 | Leibreich | |
| 3,516,615 | A | 6/1970 | Wickenberg | |
| 3,626,491 | A | 12/1971 | Grosser | |
| 3,641,412 | A | 2/1972 | Hayashi | |
| 3,730,409 | A | 5/1973 | Ratti | |
| D230,637 | S | 3/1974 | Clement | |
| D249,352 | S | 9/1978 | Kirchhoff | |

(Continued)

FOREIGN PATENT DOCUMENTS

| | | |
|---|---|---|
| GB | 231765 | 10/1924 |

(Continued)

OTHER PUBLICATIONS

Print Inform GmgH & Co., a Germany company, 3 photographs of Hand Held Roll Note Dispenser, offered for sale in 1990, pp. 1-3.

(Continued)

*Primary Examiner*—William A Rivera
(74) *Attorney, Agent, or Firm*—Drinker Biddle & Reath LLP

(57) ABSTRACT

A dispenser for dispensing a repositionable adhesive note paper from a roll includes a housing defining an interior and a discharge opening. A drive system of the dispenser includes a roller rotatably mounted within the housing interior and a motor engaging the roller to rotate the roller with respect to the housing about a central axis of the roller. A pressure member is located within the housing and is preferably movable with between an engaged position where it urges the paper into contact with the roller and a disengaged position where it is separated from the roller to permit loading of paper.

33 Claims, 3 Drawing Sheets

U.S. PATENT DOCUMENTS

| | | | | |
|---|---|---|---|---|
| 4,327,875 | A | 5/1982 | Lightfoot | |
| D273,644 | S | 5/1984 | Colavito et al. | |
| 4,625,901 | A | 12/1986 | Adelizi | |
| 4,630,765 | A | 12/1986 | Samuelson et al. | |
| 4,646,956 | A | 3/1987 | Ruff et al. | |
| 4,676,131 | A | 6/1987 | Cassia | |
| 4,690,344 | A * | 9/1987 | Yokota | 242/564.1 |
| D308,891 | S | 6/1990 | Harris | |
| 4,989,801 | A | 2/1991 | Thomas et al. | |
| D325,394 | S | 4/1992 | Ishii | |
| D327,192 | S | 6/1992 | Geuvjehizian | |
| D329,464 | S | 9/1992 | Hu | |
| 5,370,916 | A | 12/1994 | Olsen | |
| 5,417,783 | A | 5/1995 | Boreali et al. | |
| 5,452,832 | A | 9/1995 | Niada | |
| 5,478,000 | A * | 12/1995 | Jensen | 225/93 |
| 5,540,369 | A | 7/1996 | Boreali et al. | |
| 5,549,232 | A | 8/1996 | Scholfied | |
| 5,904,283 | A | 5/1999 | Kanbar | |
| 5,904,285 | A | 5/1999 | Anderson et al. | |
| 6,210,768 | B1 | 4/2001 | Blok et al. | |
| 6,412,655 | B1 | 7/2002 | Stuetzel et al. | |
| 6,736,038 | B1 * | 5/2004 | Hong | 83/156 |
| 6,745,927 | B2 | 6/2004 | Formon et al. | |
| 6,892,620 | B2 | 5/2005 | Kapiloff | |
| 6,895,848 | B1 | 5/2005 | Svensson | |
| 2007/0062998 | A1 | 3/2007 | Kanbar | |
| 2007/0257147 | A1 * | 11/2007 | Kanbar et al. | 242/564.4 |

FOREIGN PATENT DOCUMENTS

| | | |
|---|---|---|
| GB | 2 317 365 | 3/1998 |
| JP | 9323772 | 12/1997 |
| JP | 2002 238800 | 8/2002 |
| JP | 2002 274716 | 9/2002 |

OTHER PUBLICATIONS

Z-International Roll Notes Web Page showing products known to be publicly available prior to Sep. 2005, pp. 1-2.

* cited by examiner

MOTORIZED ADHESIVE PAPER DISPENSER

FIELD OF THE INVENTION

The present invention relates generally to dispensers adapted for dispensing paper from a roll and, more particularly, to a motorized dispenser for dispensing an adhesive note paper.

BACKGROUND OF THE INVENTION

Adhesive note paper, such as POST-IT® note paper by 3M Company of St. Paul, Minn., includes sheets of paper having a low-tack pressure-sensitive adhesive on the back of each sheet. The pressure-sensitive adhesive allows a user to removably adhere the note paper to a surface, such as a document that the user wishes to associate a note without marking the document by writing directly on the document. The low-tack pressure-sensitive adhesive allows for subsequent removal of the note paper from the surface without resulting damage to the surface. The sheets of adhesive note paper are provided in stacks from which individual sheets are removed.

It is also known, as disclosed in U.S. Pat. No. 5,904,283 (Kanbar), to provide a roll of adhesive note paper. The note paper of the roll includes a band of low-tack adhesive on one side of the note paper. Kanbar also discloses a dispenser for dispensing the adhesive note paper from the roll. The note paper is directed from the roll, which is rotatably mounted on a shaft, onto a motor-driven conveyor belt such that the note paper adheres to the belt. A dispenser for dispensing an adhesive note paper from a roll having an endless conveyor belt onto which the paper is directed is also disclosed in U.S. Pat. No. 4,327,875.

SUMMARY OF THE INVENTION

According to the present invention, a dispenser for dispensing an adhesive note paper from a roll comprises a housing defining an interior and a discharge opening. The roll of adhesive note paper is rotatably mounted within the interior of the housing. The dispenser also comprises a drive system including a roller rotatably mounted within the housing interior and a motor engaging the roller to rotate the roller with respect to the housing about a central axis of the roller. The dispenser further comprises a pressure member located within the housing interior and movable with respect to the roller of the drive system between an engaged position and a disengaged position. The pressure member is adapted to create pressure between the pressure member and the roller in the engaged position.

According to one embodiment of the invention, the roller is rotatably mounted on an outer surface of a mounting tube and the motor of the drive system is located within the roller inside the mounting tube.

The dispenser includes a drive system actuator for actuating the drive system motor. In one embodiment, the actuator preferably includes a button arranged for activation by a user, such as depressing the button relative to the housing. The actuator includes first and second electrical contacts arranged for contact with each other when the button is depressed by the user with respect to the housing. The contact between the electrical contacts closes a circuit, thereby activating the drive system motor.

The electrical contacts of the actuator may be secured to the pressure member and arranged such that the depressing of the actuator button results in contact between the actuator contacts.

According to another aspect of the invention, an adhesive note paper dispenser comprises a roll of an adhesive note paper having a pressure-sensitive adhesive on one side of the paper and a paper driving system. The paper driving system includes a roller rotatably supported for rotation about a central axis of the roller and a motor. The roller includes a body defining a substantially cylindrical outer surface and an interior. The motor is located within the interior of the roller body and has an output shaft engaging the roller to transfer rotation of the output shaft to the roller. The dispenser also comprises a pressure plate supported for movement between a disengaged position in which the pressure plate is separated from the roller and an engaged position. In the engaged position, the pressure plate urges the adhesive note paper against the outer surface of the roller, thereby causing the roller to drive the adhesive note paper.

BRIEF DESCRIPTION OF THE DRAWINGS

For the purpose of illustrating the invention, the drawings show a form of the invention that is presently preferred. However, it should be understood that this invention is not limited to the precise arrangements and instrumentalities shown in the drawings.

DESCRIPTION OF THE INVENTION

Figure 1:
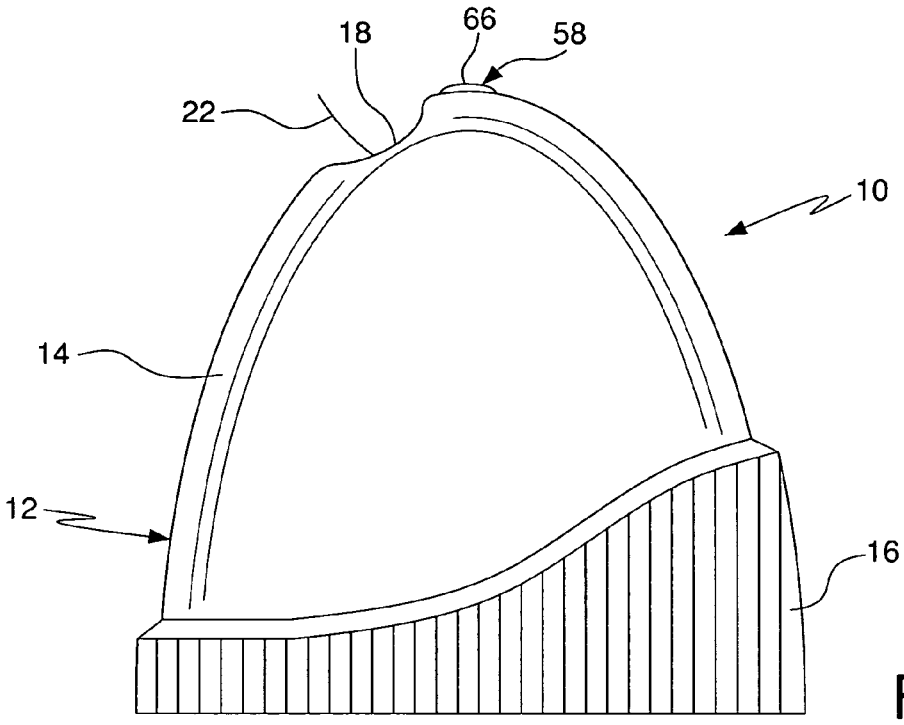
FIG. 1 is a side view of an adhesive note paper dispenser according to an exemplary embodiment of the invention.

Referring to the drawings, where like numerals identify like elements, there is illustrated in the figures a dispenser 10 for dispensing an adhesive note paper according to the present invention. The adhesive note paper may be of the type disclosed in U.S. Pat. No. 5,904,283 including a roll of paper strip having a band of a low-tack pressure-sensitive adhesive extending longitudinally along the center line of the paper strip. U.S. Pat. No. 5,904,283 is incorporated herein by reference in its entirety. It is, however, contemplated that the adhesive roll can be arranged differently, including multiple strips of adhesive, or adhesive strips located along one edge as opposed to the center.

Figure 2:
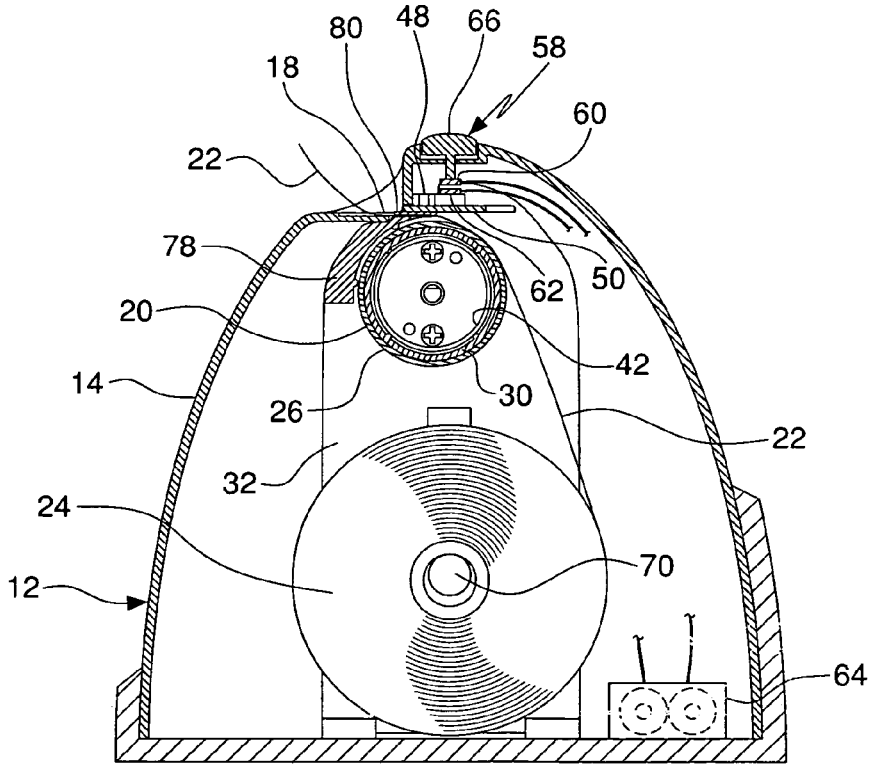
FIG. 2 is a sectional view of the dispenser of FIG. 1.

Referring to FIGS. 1 and 2, the dispenser 10 includes a housing 12 defining an interior and including a cover 14 attached to a base 16. The cover 14 includes a discharge opening 18 preferably in the form of a thin slot adapted to accommodate a width of the adhesive note paper being discharged from the interior of the housing 12. The discharge opening 18 of the depicted dispenser is located near a top end of the housing 12 from the point of view shown in FIGS. 1 and 2. This is not, however, a requirement of the invention, and it is envisioned that the discharge opening 18 could be located elsewhere on the housing 12. The location of the discharge opening near the top permits easy dispensing of the note and, thus, is preferred.

The dispenser 10 includes a drive system 20 for directing the adhesive note paper 22 outwardly from the housing 12 via the discharge opening 18. As discussed above, the adhesive note paper 22 is preferably provided in the form of a roll 24 that is located within the housing interior. The drive system includes a roller 26 rotatably supported within the interior of housing 12. The roller 26 includes a body 28 having a substantially cylindrical outer surface adapted for contact with the paper 22, in the manner described below, to drive or pull the paper from the roll 24. The drive system 20 in the illustrated embodiment includes a roller mounting tube or support 30 preferably having a substantially cylindrical outer surface. In the illustrated embodiment, the body 28 of the roller 26 is open at a first end of the roller 26 for receipt of the mounting tube 30 within the roller 26. As will be discussed below, this arrangement permits relative rotation between the roller 26 and the mounting tube 30 about a central axes of the roller 26.

Figures 3, 3A:
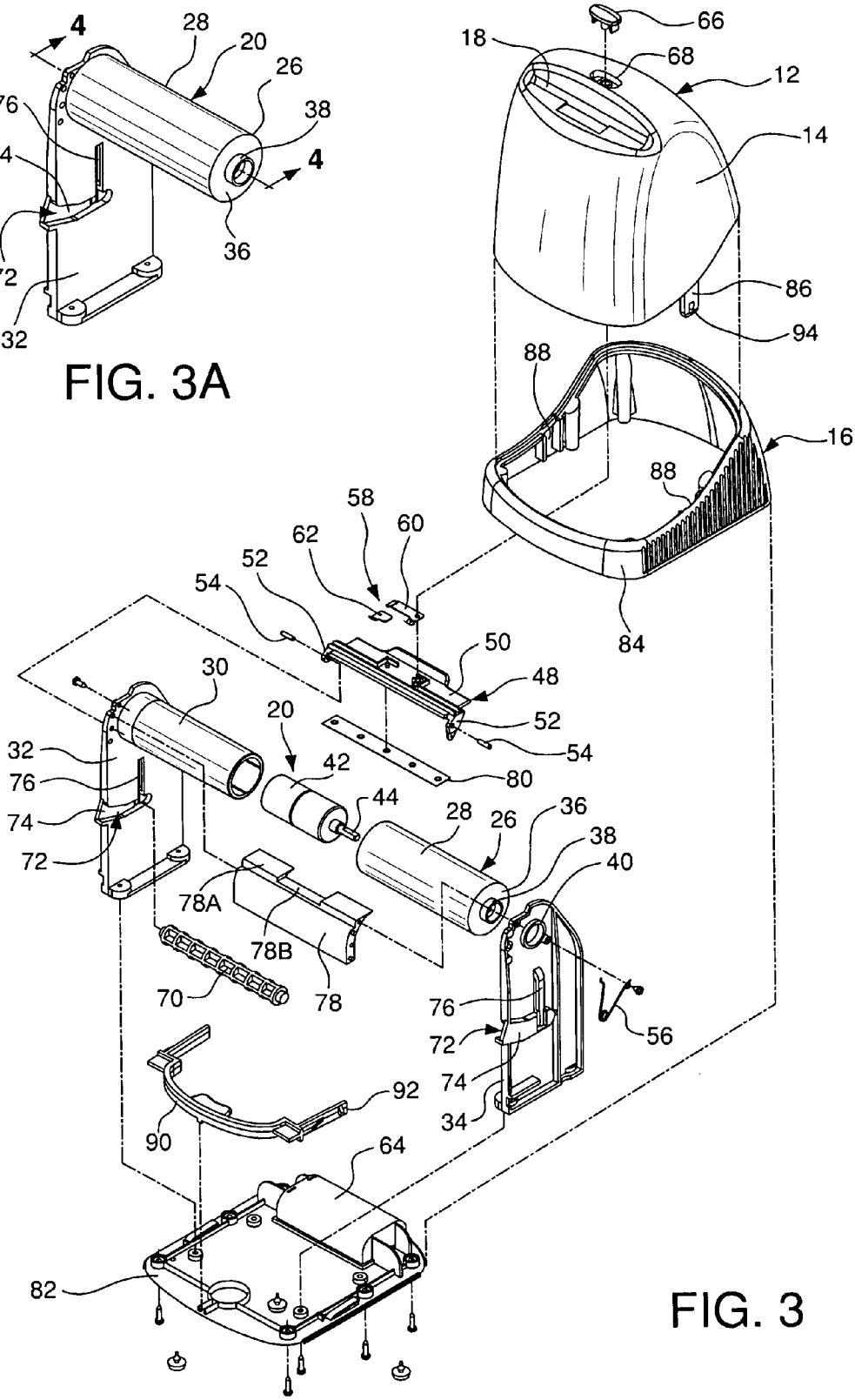
FIG. 3 is an exploded perspective view of the adhesive note paper dispenser of FIG. 1.
FIG. 3A illustrates the assembled drive system.

Referring to FIG. 3, the dispenser 10 includes first and second support brackets 32, 34 for supporting the roller 26 and the roller mounting tube 30 within the interior of housing 12 at a distance from the base 16. In the illustrated embodiment, each of the support brackets 32, 34 is secured to a bottom plate of the base 16 by fastening a flanged portion of the support bracket to the base 16. However, it is also contemplated that the brackets 32, 34 can be formed integrally with base 16 or the cover 14. A first end of the roller mounting tube 30 is supported by the first bracket 32 such that the mounting tube extends substantially perpendicular to the bracket 32 as shown. The tube 30 and first bracket 32 could comprise initially separate elements having interfitting formations for connecting the mounting tube 30 to the first bracket 32. Alternatively, the roller tube 30 and bracket 32 could be integrally formed as a unit (e.g., from a moldable plastic material).

The roller 26 includes an end wall 36 at a second end of the roller 26 opposite the open end of the body 28. An annular fitting 38 included on an outer surface of the end wall 36 is slidably received by an opening 40 defined by the second bracket 34. The slidable receipt of the annular fitting 38 by the bracket opening 40 provides rotatable support for second end of the roller 26. In this manner, the roller 26 is rotatably supported at the second end of the roller 26 by the second bracket 34 and over the rest of the roller 26 by the mounting tube 30, which is in turn supported by the first bracket 32. FIG. 3A illustrates the assembled drive system 20.

Figure 4:
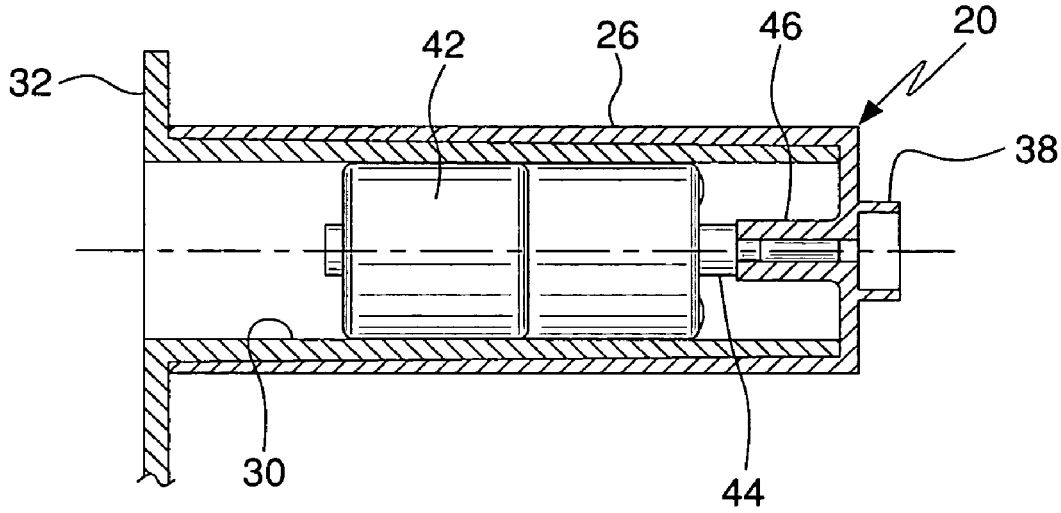
FIG. 4 is a section view of a drive system of the dispenser of FIG. 1.

Referring to FIG. 4, the drive system 20 includes a motor 42 having an output shaft 44 that is rotatingly driven by the motor 42. As shown, the motor 42 of the depicted dispenser 10 is located within the interior of the mounting tube 30 and is preferably arranged such that the output shaft 44 of motor 42 is located inside the mounting tube and is engaged with a socket 46 located within the interior of the roller 26. The socket 46 is preferably located on an inner surface of the end wall 36 of roller 26. The output shaft 44 and the socket 46 are adapted to engage each other such that rotation of the output shaft 44 by motor 42 results in rotation of the roller 26 with respect to the mounting tube 30. According to one presently preferred embodiment, the output shaft include one or more flattened surfaces designed to engage or key into surfaces formed on or in the socket to facilitate transfer of torque between the motor output shaft 44 and the roller 26. It is contemplated that the end of the output shaft may, for example, be splined, D-shaped or have some other non-circular shape that engages with a mating shape formed in the socket. Preferably, the inner surface of the mounting tube 30 defines one or more formations (e.g., longitudinal grooves, projections or abutments) for receiving cooperative formations on or otherwise engaging the exterior of the motor 42 to restrict or inhibit relative rotation between the motor 42 and the mounting tube 30. In a preferred embodiment, adhesive is also used to further secure the motor to the tube. Thus, the motor 42 is, in this embodiment, substantially fixed to the mounting tube 30 and, hence, the base.

Although the depicted dispenser 10 includes a mounting tube 30 as described above, it is conceivable that the roller 26 could be rotatably supported by the brackets 32, 34 at the opposite ends of the roller 26 without a mounting tube. In such an alternative construction, the motor and/or the output shaft would be positioned within the interior of the roller 26 and a roller-engaging element, such as drive wheel or socket, would engage the output shaft of the motor to an inner surface of the roller. The motor, in turn, would be supported by at least one of the brackets such that the motor does not rotate.

Referring back to the figures, the dispenser 10 includes a pressure member 48 supported within the interior of the housing 12. Although not a requirement, the pressure member 48 could be designed so as to provide movement between engaged and disengaged positions with respect to the roller 26. As described below, the adhesive paper 22 is received between the pressure member 48 and the body 28 of roller 26 such that, the pressure member 48 presses or urges the paper against the outer cylindrical surface of the roller body 28. The pressure generated between the pressure member 48 and the roller 26 causes the adhesive to adhere to the roller 26, thus permitting the rotation of the roller to drive the adhesive paper 22 between the roller 26 and the pressure member 48.

The pressure member 48 includes an elongated plate portion 50 having a lower surface, from the point of view shown in FIGS. 2 and 3. When the pressure member 48 is in its engaged position with the paper, the lower surface of the plate portion 50 contacts the adhesive paper 22. The pressure member 48 also includes mounting flanges 52 located at opposite ends of the plate portion 50. Pins 54 are received in aligned openings in the mounting flanges 52 and the brackets 32, 34, respectively, to provide pivotable support of the pressure member 48 with respect to the brackets 32, 34. The pivoting of the pressure member 48 moves the pressure member 48 between its disengaged position, in which the plate portion 50 is separated from the roller 26, and its engaged position, in which the plate portion 50 contacts the body 28 of roller 26 (or contacts the adhesive paper 22 when the adhesive paper is located between the roller and the pressure member.) The disengaged position of the pressure member permits easy loading of paper between the roller and the pressure member. It should be readily apparent that the pins may be formed integral with the pressure member or the brackets.

The dispenser 10 includes a spring or biasing device 56 for urging the pressure member 48 towards the engaged position. The depicted spring 56 is a hair spring having a coil portion and first and second legs extending from the coil portion. The first leg is secured to the second bracket 34. The second leg is engaged with an opening formed in one of the flanges 52 of the pressure member 48. Arranged in this manner between the pressure member and the bracket, the spring functions to urge the plate portion 50 of the pressure member 48 down during normal operation. The spring is positions such that, when the pressure member 48 is raised to its disengaged position, the pressure exerted goes over center, thus holding the pressure member 48 in its raised position. When the pressure member 48 is then lowered, the spring tension goes past center and urges the pressure plate 48 against to roller. Other mechanisms can be used to bias the pressure member into its engaged position, such as a compression spring, coil or leaf spring. Furthermore, the spring need not be a separate element. It is contemplated that the spring can be formed as an integral part of the pressure member or the brackets.

The dispenser 10 includes a drive system actuator 58 for controlling the operation of the drive system 20. The drive system actuator 58 includes first and second electrical contacts 60, 62 preferably secured to an upper surface of the plate portion 50 of pressure member 48. The electrical contacts 60, 62 are adapted to close an electrical circuit when they contact each other such that current is directed to the motor 42 of drive system 20 from a source of power. In the depicted embodiment, the power source is provided by batteries located within a battery compartment 64 on the bottom 82 of the housing base 16. However, the power course could be any conventional power source, such as an AC current source. In the illustrated embodiment, the first electrical contact 60 includes an elongated arm having a distal end located above the second electrical contact 62. The arm of the first electrical contact 60 is adapted to flex to move the distal end of the first electrical contact 60 into contact with the second electrical contact 62. The contacts 60, 62 are arranged such that they are normally out of contact with each other so that the motor is normally not powered to rotate the roller 26. The electrical connection of the contacts between the motor and the power source is otherwise conventional and, therefore, no further discussion is needed.

The drive system actuator 58 also includes a button 66 adapted for contact by a user to activate the drive system 20 of the dispenser 10. The button 66 is located in an opening 68 formed in the housing cover 14 preferably at or near the top of the housing 12 such that the button contacts the distal end of the first electrical contact 60 of the actuator 58. Arranged in this manner, the button 66 functions to flex the first electrical contact 60 when the button 66 is depressed by the user with respect to the housing cover 14 causing the first electrical contact 60 to contact the second electrical contact 62.

The dispenser preferably includes an axle 70 for supporting a roll 24 of adhesive note paper within the interior of the housing 12. The axle 70 is adapted to extend through a central opening of the roll 24 and has opposite ends that are removably received in channels 72 formed on the brackets 32, 34. Each of the channels 72 includes a tower portion 74 extending from an edge of the associated bracket 32, 34 to provide for placement of the axle 70 into the brackets 32, 34, or removal of the axle 70. Each channel also includes a second portion 76 extending vertically from the lower portion 74. The vertical portions 76 of the channels 72 are, in the illustrated embodiment, flexible springs which use the inherent resiliency of the material (plastic in this embodiment) to act as detents to hold the axle in place. The vertical portions may be designed to provide automatic adjustment of the height of the axle 70 above the base 16 as the size of the roll is diminished by discharge of the paper.

The dispenser 10 preferably includes an exit guide 78 having opposite ends secured to the brackets 32, 34 adjacent the discharge opening 18. The exit guide 78 is adapted to guide the adhesive note paper being driven from the roll 24 by the drive system 20 towards the discharge opening 18. As shown in FIG. 3, the guide 78 includes at least one and preferably two raised portions 78A and a recessed portion 78B adjacent to the raised portion. The raised portion 78A facilitates separation of the note paper from the roller as shown in FIG. 2. The recessed portion 78B is spaced apart from the adhesive when the note paper is on the raised portion 78A of the guide. In embodiment shown in FIG. 3, the raised portion 78A is two spaced apart arms with the recessed portion 78B located between the arms.

The dispenser 10 includes a tear bar 80 preferably attached or formed on the lower surface of the plate portion 50 of pressure member 48. The tear bar 80 is located adjacent to the discharge opening 18. The tear bar 80 includes a relatively sharp edge that facilitates tearing of the note paper when the paper is pulled transverse to the opening. Preferably, the tear bar 80 is secured to the pressure member 48 by welding (e.g., heat staking) the tear bar to the plate portion 50 of the pressure member 48. However, it is also contemplated that the tear bar 80 may be a sharp edge that is formed integral with the pressure member.

The base 16 includes a bottom plate 82 and an upstanding wall 84. In the depicted embodiment, the bottom plate 82 of the base 16 is secured to the wall 84 by fasteners. However, it is also contemplated that the entire base can be molded as a single piece. The cover 14 of housing 12 preferably includes attachment tabs 86 on opposite sides of the cover 14 that are designed to engage with channel guides 88 located on opposite sides of the base wall 84. The dispenser 10 may also include a cover retension spring 90 having projections 92 on opposite arms of the spring 90. The projections 92 on the cover retension spring 90 are received in openings 94 formed in the cover tabs 86 for retaining the cover 14 of the housing 12 on the base 16.

The spring 90 is designed such that when pressure is applied to its center point, due to the location of the pivot points in the bottom cover, the latching tabs 92 are withdrawn from the openings 94 in tabs 86. The center release point of the spring 90 is accessed through a hole in the plate 82 that is aligned with the center release point. The center release point includes a button for the user to push to depress the spring 90.

While the motor in the illustrated embodiment is shown mounted within the roller, it should be readily apparent that the motor can be positioned outside the roller and include a mechanism, such as a belt, gear or direct interconnection to rotate the roller.

One of the features of the design is the ability to utilize the adhesive on the paper to facilitate drawing or movement of the paper out of the dispenser. The adhesive contacts the roller and provides sufficient adhesion to allow the roll to pull the paper off the roll. The pressure plate assists in the causing the paper to adhere to the roll.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A motorized dispenser for dispensing an adhesive note paper from a roll, the note paper having a low-tack pressure-sensitive adhesive on one side of the paper, the dispenser comprising:

a housing defining an interior and a discharge opening;

a drive system including a roller rotatably mounted within the housing interior and a motor engaging the roller, the motor adapted to rotate the roller with respect to the housing about a central axis of the roller;

a pressure member located within the housing interior and adapted to create pressure between the pressure member and the roller for causing the roller to drive an adhesive paper located between the roller and the pressure member and towards the discharge opening of the housing; and a guide located within the housing adjacent to the roller for separating a note paper from the roller and guiding the note paper through the discharge opening, the guide having at least one raised portion and a recessed portion adjacent to the raised portion.

2. The dispenser according to claim 1, further comprising a roll of an adhesive note paper rotatably mounted within the interior of the housing, the roll positioned within the housing so as to permit the note paper to extend from the roll between the pressure member and the roller, the adhesive on the note paper removably adhering the note paper to the roller so that rotation of the roller extracts the note paper from the roll, and wherein the at least one raised portion facilitates separation of the note paper from the roll and wherein the recessed portion is spaced apart from at least a portion of the adhesive when the note paper is on the raised portion of the guide.

3. The dispenser according to claim 1, wherein the pressure member includes a plate portion creating the pressure between the pressure member and the drive system roller, and mounting flanges at opposite ends of the pressure member, the mounting flanges pivotally supported within the housing interior for rotation of the pressure member about a mounting axis.

4. The dispenser according to claim 3, further comprising a pair of spaced upright brackets located within the interior of the housing, the brackets adapted to support the mounting flanges of the pressure member at opposite ends of the pressure member.

5. The dispenser according to claim 1 further comprising a spring contacting the pressure member to urge the pressure member towards the roller.

6. The-dispenser according to claim 1 wherein at least a portion of the motor of the drive system is located within a recessed interior defined by the roller.

7. The dispenser according to claim 6, wherein the drive system includes a roller mounting tube, the roller mounting tube having an outer surface adapted to slidingly receive the roller for relative rotation between the roller and the roller mounting tube, the motor mounted within an interior of the roller mounting tube.

8. The dispenser according to claim 7, wherein the motor includes an output shaft, and wherein the recess of the roller includes an end wall and a socket on the end wall inside the recess, the output shaft of the motor engaged with the socket such that the output shaft is adapted to rotate the roller when the motor is activated.

9. The dispenser according to claim 1 further comprising an axle removably supported within the housing interior, the axle adapted to extend through a central opening in the roll of the adhesive paper to rotatably support the roll.

10. The dispenser according to claim 9, further comprising a roll of paper having adhesive formed on one side, the roll being removably supported by the roll support, the roll or paper being oriented such that the side with the adhesive removably engages with the roller, the adhesion of the paper to the roller facilitating translation of the paper out of housing.

11. The dispenser according to claim 1 further comprising an actuator for activating the drive system motor, the actuator including a button mounted to the dispenser and that can be depressed by a user, the actuator including first and second electrical contacts arranged for contact with each other when the button is depressed by the user, the contact between the first and second electrical contacts closing a circuit to activate the motor.

12. The dispenser according to claim 11, wherein the actuator contacts are secured to the pressure member and arranged such that the depressing of the actuator button results in contact between the actuator contacts.

13. The dispenser according to claim 1, wherein the motor of the drive system is located external to the roller.

14. The dispenser according to claim 1, wherein the at least one raised portion is two spaced apart arms with the recessed portion being located in between the arms, the arms including distal edges adapted to separate the note paper from the roller, the guide arms being located positioned so as to be adjacent to the opposite ends of the roller.

15. The dispenser according to claim 14, wherein at least a portion of the roller is positioned between the arms.

16. The dispenser according to claim 14, wherein the roller is positioned within the housing so as to be engaged with the adhesive portion of the note paper between the arms of the guide.

17. The dispenser according to claim 1, further comprising an activation switch mounted to the housing, the activation switch being located on the housing adjacent to the pressure plate.

18. The dispenser according to claim 1, further comprising a cutting edge for severing a piece of note paper after dispensing, the cutting edge being pivotally mounted on the dispenser so that it can be pivoted relative to a lower portion of the housing, wherein the cutter can be pivoted out of engagement with the note paper for replacing the roll.

19. A motorized adhesive note paper dispenser comprising:

a roll of an adhesive note paper having a pressure-sensitive adhesive on a portion of one side of the paper;

a housing having an interior and a discharge opening;

a paper driving system located within the housing and including a roller rotatably supported for rotation about a central axis of the roller and a motor, the roller including a body defining a substantially cylindrical outer surface and an at least partially hollow interior defining a recess inside the roller, the motor at least partially located within the recess of the interior of the roller body and having an output shaft engaging the roller to rotate the roller when the motor is activated; and a pressure plate having an engaged position in which the pressure plate generates a pressure between the pressure plate and the outer surface of the roller for driving the adhesive note paper from the roll between the roller and the pressure plate;

wherein the roll is rotatably and removably mounted within the interior of the housing, the roll of paper being oriented such that the side with the adhesive removably engages with the outer surface of the roller between the roller and the pressure plate, the adhesion of the paper to the roller facilitating translation of the paper out of housing.

20. A dispenser according to claim 19 wherein the pressure plate has a disengaged position in which the pressure plate is separated from the roller for loading of paper, the pressure plate being mounted so as to be movable between the disengaged and engaged positions.

21. A motorized dispenser for dispensing an adhesive note paper from a roll, the note paper having a low-tack pressure-sensitive adhesive on one side of the paper, the dispenser comprising:

a housing having a removable upper section and a base, the upper section including a discharge opening, the housing having an interior;

a drive system including a roller rotatably mounted with the interior of the housing and a motor attached to the base and engaged with the roller such that, when the motor is activated, it rotates the roller about a central axis of the roller;

a roll support spaced apart from the roller and designed to support a roll of adhesive paper;

a pressure member located within the housing interior and adapted to urge an adhesive paper located between the roller and the pressure member against the roller;

a roll of adhesive note paper, the note paper having adhesive formed on a portion of one side, the roll being disposed on the roll support so as to be rotatably mounted within the interior of the housing, the roll of note paper being oriented such that the side of the note paper with the adhesive removably engages with an outer surface of the roller between the roller and the pressure member, the adhesion of the note paper to the roller facilitating translation of the paper out of housing, the adhesive paper roll being disposed on and supported by the roll support; and a guide located within the housing adjacent to the roller and the discharge opening for separating the note paper from the roller and guiding the note paper through the discharge opening.

22. A dispenser according to claim 21 wherein the motor includes an output shaft that is engaged with the roller for rotating the roller.

23. A dispenser according to claim 22 wherein the output shaft engages with a socket formed in the inside of the roller.

24. The dispenser according to claim 22, wherein the motor is located external to the roller.

25. A dispenser according to claim 21 wherein the motor has an output drive shaft directly connected to the motor which rotates about a central axis, the central axis of the output drive member and the central axis of the roller being coincident with one another.

26. The dispenser according to claim 21, wherein the guide includes spaced apart arms with a recessed portion in between, the arms including distal edges adapted to separate the note paper from the roller, the guide arms being located positioned so as to be adjacent to the opposite ends of the roller.

27. The dispenser according to claim 26, wherein a portion of the roller is positioned between the arms.

28. A motorized dispenser for dispensing an adhesive note paper from a roll, the note paper having a low-tack pressure-sensitive adhesive on one side of the paper, the dispenser comprising:

a housing defining an interior and a discharge opening, the housing including an upper cover and a base which form and enclosure, the upper cover being attached to the base so as to permit the cover to be moved relative to the base to allow access to the interior;

a drive system including a roller rotatably mounted within the housing interior and a motor at least partially located within a recessed interior portion of the roller and engaged with the roller, the motor adapted to rotate the roller with respect to the housing about a central axis of the roller upon activation, the roller having an outer surface;

a roll support mounted within the interior of the housing and spaced apart from the roller;

a roll of adhesive note paper, the note paper having adhesive formed on at least a portion of one side, the roll being removably mounted on the roll support so as to be rotatable within the interior of the housing, the roll of note paper being oriented such that the side of the note paper with the adhesive removably engages with the outer surface of the roller, the adhesion of the note paper to the roller facilitating translation of the paper out of housing, wherein the location of the roll support in the housing is such that the roll is positioned in the enclosure between the upper cover and the base, wherein the roll can be replaced by moving the upper cover so as to permit access to the interior of the housing; and a contact surface located within the housing for applying pressure to a side of the note paper that is opposite from the side with the adhesive, the note paper extending between the roller and the contact surface.

29. The dispenser according to claim 28, wherein the drive system includes a mounting tube mounted to the housing, wherein the motor is attached to the mounting tube, the mounting tube being located within an interior of the roller.

30. The dispenser according to claim 28, further comprising a guide located between the roller and the discharge opening for separating the note paper from the roller and guiding the note paper through the discharge opening.

31. A motorized dispenser for dispensing an adhesive note paper from a roll, the note paper having a low-tack pressure-sensitive adhesive on one side of the paper, the dispenser comprising:

a housing defining an interior and a discharge opening;

a drive system including a roller rotatably mounted within the housing interior and a motor at least partially located within a recessed interior portion of the roller and engaged with the roller, the motor adapted to rotate the roller with respect to the housing about a central axis of the roller upon activation, the roller having an outer surface;

a roll support mounted within the interior of the housing and spaced apart from the roller;

a roll of adhesive note paper, the note paper having adhesive formed on at least a portion of one side, the roll being removably mounted on the roll support so as to be rotatable within the interior of the housing, the roll of note paper being oriented such that the side of the note paper with the adhesive removably engages with the outer surface of the roller, the adhesion of the note paper to the roller facilitating translation of the paper out of housing;

a contact surface located within the housing for applying pressure to a side of the note paper that is opposite from the side with the adhesive, the note paper extending between the roller and the contact surface; and a guide located adjacent to the roller and the discharge opening for separating the note paper from the roller and guiding the note paper through the discharge opening wherein the guide includes spaced apart arms with a recessed portion in between, the arms including distal edges adapted to separate the note paper from the roller, the guide arms being located positioned so as to be adjacent to the opposite ends of the roller.

32. A motorized dispenser for dispensing an adhesive note paper from a roll, the note paper having a low-tack pressure-sensitive adhesive on one side of the paper, the dispenser comprising:

a housing defining an interior and a discharge opening, the housing adapted to enclose a roll of adhesive note paper, the housing including an upper housing section and a lower housing section, the upper housing section being movable relative to the lower housing section for permitting access to the interior of the housing for replacing the note paper when the upper housing section is moved relative to the lower housing section, and the housing including a lock for locking the upper housing section to the lower housing section;

a drive system including a roller rotatably mounted within the housing interior and a motor located within and attached to the housing and engaged with the roller, the motor adapted to rotate the roller with respect to the housing about a central axis of the roller upon activation, the roller having an outer surface;

a roll of adhesive note paper, the note paper having adhesive formed on a portion of one side, the roll being rotatably disposed within the interior of the housing and covered by the outer housing section when the outer housing section is disposed over the lower housing section, the roll of note paper being oriented such that the side of the note paper with the adhesive removably engages with the outer surface of the roller, the adhesion of the note paper to the roller facilitating translation of the paper out of housing; and a contact surface located within the housing for applying pressure to a side of the note paper that is opposite from the side with the adhesive, the note paper extending between the roller and the contact surface, the contact surface being pivotally mounted on the dispenser so that it can be pivoted relative to the roller; and a cutting edge for severing a piece of note paper after dispensing, the cutting edge being pivotally mounted on the dispenser so that it can be pivoted relative to the lower housing section, wherein the cutting edge can be pivoted out of engagement with the note paper for replacing the roll.

33. The dispenser according to claim 32, wherein the lock includes at least one opening formed in the upper housing section and a tab in the lower housing section that engages with the opening when the upper housing section is engaged with the lower housing section, the tab being biased into engagement with the hole.

* * * * *

UNITED STATES PATENT AND TRADEMARK OFFICE

CERTIFICATE OF CORRECTION

PATENT NO. : 7,637,452 B2
APPLICATION NO. : 11/416114
DATED : December 29, 2009
INVENTOR(S) : Kanbar et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 703 days.

Signed and Sealed this

Ninth Day of November, 2010

David J. Kappos

David J. Kappos
*Director of the United States Patent and Trademark Office*